US012338054B2

(12) United States Patent
Tumber et al.

(10) Patent No.: US 12,338,054 B2
(45) Date of Patent: Jun. 24, 2025

(54) INSULATED SHIPPING CONTAINERS WITH COMPOUND INSULATION HAVING SPACE THEREBETWEEN

(71) Applicants: Jim Tumber, Barrington, RI (US); Alton Williams, Miami, FL (US)

(72) Inventors: Jim Tumber, Barrington, RI (US); Alton Williams, Miami, FL (US)

( * ) Notice: Subject to any disclaimer, the term of this patent is extended or adjusted under 35 U.S.C. 154(b) by 270 days.

(21) Appl. No.: 15/944,536

(22) Filed: Apr. 3, 2018

(65) Prior Publication Data

US 2018/0282049 A1 Oct. 4, 2018

Related U.S. Application Data

(60) Provisional application No. 62/480,964, filed on Apr. 3, 2017.

(51) Int. Cl.

| | |
|---|---|
| ***B65D 81/38*** | (2006.01) |
| ***B65D 77/04*** | (2006.01) |
| *F25D 3/06* | (2006.01) |

(52) U.S. Cl.

CPC ..... *B65D 81/383* (2013.01); *B65D 77/0413* (2013.01); *B65D 81/3816* (2013.01); *B65D 81/3818* (2013.01); *B65D 81/3832* (2013.01); *B65D 81/3827* (2013.01); *F25D 3/06* (2013.01); *F25D 2331/804* (2013.01)

(58) Field of Classification Search

CPC ..... B65D 81/383; B65D 81/3825; B65D 81/3818; B65D 77/0413; F25D 3/06; F25D 2331/804

See application file for complete search history.

(56) References Cited

U.S. PATENT DOCUMENTS

| | | | | |
|---|---|---|---|---|
| 1,865,688 A * | 7/1932 | Hannaford | ..... | B65D 5/566 62/371 |
| 3,353,886 A * | 11/1967 | Tompkins | ..... | B65D 81/3825 312/400 |
| 5,979,693 A * | 11/1999 | Bane, III | ..... | B65D 81/3825 220/23.9 |
| 7,866,539 B2 * | 1/2011 | Senftner | ..... | B65D 81/3862 229/103.11 |

* cited by examiner

*Primary Examiner* — Andrew T Kirsch

(74) *Attorney, Agent, or Firm* — Kristina Castellano; CASTELLANO PLLC

(57) ABSTRACT

Provided are insulated shipping containers and shipping container systems that include outer side boundaries, in which a container or box may be contained, which outer side boundaries include smooth side walls and corresponding ridged side walls, wherein the smooth side walls and corresponding ridged side walls face one another and have one or more ridges therebetween, such that taken together, the facing smooth side walls and ridged walls form at least one side space therebetween and form outer side boundaries of an insulated shipping container. The insulated shipping containers may also include a top and/or bottom boundary that also include at least two layers, having ridges or other spacer therebetween to form at least one top and/or bottom space. The present systems may further include an overshipper box and/or one or more interior boxes, which may be adapted to include e.g., a payload and/or heat transfer element therein for temperature control. Further provided are kits which may include one or more components used in the present containers and/or systems, and methods of assembling such containers and/or systems.

20 Claims, 3 Drawing Sheets

INSULATED SHIPPING CONTAINERS WITH COMPOUND INSULATION HAVING SPACE THEREBETWEEN

RELATED APPLICATION

The present application claims the benefit of U.S. Provisional Application No. 62/480,964 filed on Apr. 3, 2017, which is hereby incorporated herein by reference in its entirety.

FIELD

The present invention relates generally to insulated shipping containers, and more particularly to systems, devices, methods and kits that provide insulated containers with compound insulation, having space therebetween, that are used to transport temperature-sensitive products.

BACKGROUND

During transport, certain temperature-sensitive medicinal, preventative and diagnostic products and organs, such as biopharmaceuticals, vaccines, diagnostic testing reagents and blood, are vulnerable to damage caused by variations in environmental (ambient) temperatures that are encountered in commonly traveled shipping channels. If these products are thermally damaged and are then injected into, or ingested by, a patient, the patient may suffer severe adverse reactions, or in the case of vaccines, not receive the level of protection that was intended. If these products are used to diagnose and/or monitor life-threatening illnesses, the patient may receive more or less treatment than they may require.

As a result, regulatory agencies require that manufacturers and distributors of temperature-sensitive medicinal, preventative, diagnostic and organ products develop, validate and deploy insulated shipping container systems that will successfully isolate these products from environmental temperature conditions and preserve the products' required storage condition during shipment to ensure the products' viability upon arrival.

Most common insulated shipping container systems include two basic components: a insulated shipping container, generally made out of a thermally resistant insulating material and at least one heat transfer element that is either endothermic or exothermic. Insulated shipping containers may be molded or fabricated using a variety of insulating materials, most commonly foamed plastics. Heat transfer elements may include dry ice and/or water-based ice products (such as gels, bricks, bottles, wet ice, etc.) and/or phase change materials that phase from solid to liquid state or from liquid state to solid state at temperatures above or below 0° C., and/or some combination thereof.

Current industry consensus suggests that insulated shipping containers made with insulations that have higher R-values will perform better than insulated shipping containers made with insulations that have lower R-values. Generally speaking, higher R-value insulations are more expensive than lower R-value insulations.

Current industry consensus also suggests that molded insulated shipping containers resist heat transfer better than fabricated insulated shipping containers because molded insulated shipping containers are molded as a monolithic base with a single detached lid. Molded containers reduce the number of open seams through which heat may travel.

By contrast, fabricated insulated shipping containers are assembled using foam that has been first formed into a block or bun and then cut into square-edged pads that are then used to line the six vertical and horizontal interior surfaces of a box to form a insulated shipping container. There may be for example, twelve intersections in a typical six-pad fabricated foam insulated shipping container, and at each of these intersections features an open seam through which heat may travel.

Because molded insulated shipping containers are formed in rigid tools that can hold precise tolerances, the cooperative fit between the base and the lid can be designed with keyed or stepped closure features that when fit together form a nearly air-tight seal with a longer pathway for heat to travel before it can penetrate the insulated shipping container.

By contrast fabricated insulated shipping containers are assembled from fabricated foam pads with flat edges that have tolerances to +/−⅛ inch. This wide-open tolerance makes for sloppy seams between the intersecting pads where heat can travel without significant resistance. These open seams significantly detract from the thermal performance of fabricated foam insulated shipping containers.

Insulated shipping containers may be sized to maximize the interior volume that is dedicated to product and heat transfer elements while minimizing the exterior surface area where heat transfer may occur. This is where fabricated insulated shipping containers have a commercial advantage over molded insulated shipping containers.

Molded foam tools are capital intensive and time-consuming to build, modify and maintain, and they are cumbersome to store, move and mount for use in molding presses. These significant capital and overhead costs generally limit the application of molded insulated shipping containers to those temperature-sensitive products that ship in large quantities or have strong profit margins to support the molded insulated shipping container's additional capital costs, or both.

To compensate for these shortcomings, foam molders oftentimes offer stock molded insulated shipping containers that can be adapted for use with low-volume, low-margin temperature-sensitive product shipments. One drawback to this approach is that the offered insulated shipping container sizes and shapes don't necessarily maximize the interior volume that is dedicated to product and heat transfer elements and minimize the exterior surface area where heat transfer will occur. This results in insulated shipping container systems that are either less thermally efficient than they need to be, and/or insulated shipping container systems that are larger than they have to be, thereby increasing the risk of failures or increasing shipping costs, or both.

A benefit with fabricated insulated shipping containers is that they do not require expensive specialized tooling, so they can be precisely sized to maximize the interior volume that is dedicated to product and heat transfer elements and minimize the exterior surface area where heat transfer will occur. Therefore, fabricated insulated shipping containers can be run in small quantities without having to amortize capital and set-up costs into the final price for the finished piece. Another benefit with fabricated insulated shipping containers is that they can be shipped in pieces that can are laid flat and then erected at the point of use, thereby saving on inbound freight and warehouse space.

Fabricated insulated shipping containers with the highest R-value insulation uses vacuum insulated panels (or "VIPs") also provide an insulated material. VIPs include membrane walls that envelope a panel of a rigid, highly porous material, such as fumed silica, aerogel, perlite or glass fiber. Air, which might otherwise act as a heat transfer medium, is evacuated from the enveloped panel to create a vacuum before it is sealed. Without a heat transport medium, heat transmission through the panel is significantly reduced. Generally speaking, these panels are then used to line the six vertical and horizontal interior surfaces of a box to form an insulated shipping container. In some cases, these panels can be sealed together along their edges to form a monolithic base that functions in a similar manner as a molded insulated shipping container. VIP's offer the highest R-value of any insulating material generally adapted for insulated shipping containers, but with this high R-value comes high cost, both in the capital cost of the tooling used to make VIP's, and in the unit cost of the material itself.

SUMMARY OF THE INVENTION

There is a need for improved insulation systems and devices that increase the resistant to heat transfer (R-value) while using conventional, lower R-value insulation materials. The present invention is directed to insulated shipping containers, systems, methods and kits that provide insulated containers with compound insulations, having space therebetween (which because they have more contiguous air in the system, results in an improved R-value) that are used to transport temperature-sensitive products. In general, improved insulation systems and devices could be applied to various insulated shipping containers, irrespective of the manufacturing process or material used.

In particular, by way of non-limiting example embodiment, provided herein are improved fabricated and/or molded insulated shipping containers, systems, kits, and methods related thereto, having compound wall insulation.

According to non-limiting example embodiments, with low capital and set-up costs, short production lead-times, and the ability to be readily customized, applying compound insulations to fabricated insulated shipping containers, could result in reduced cost and lead-time required to bring custom, high-performance fabricated insulated shipping containers to the market.

Other non-limiting example embodiments include molded insulated shipping containers having compound insulation, and systems, kits and methods related thereto. Embodiments utilizing this compound wall insulation can be used e.g., with molded foams to improve the R-value of these insulated shipping containers over their solid wall counterparts of the same size wall thickness and material type.

Thus, the presently disclosed invention is generally directed to improved compound insulation construction systems, devices and components thereof as the walls, bases and lids of insulated shipping containers that are used for shipping temperature-sensitive goods and products in a controlled-temperature state for an extended period of time.

The presently disclosed invention provides that by bounding a space between two layers of insulation material, heat passing through the first insulation layer will be diverted away from the second layer of insulation by way of advection (bulk heat transport) thereby resulting in an improved R-value for the wall construction that is greater than the R-value of wall construction parts taken individually.

BRIEF DESCRIPTION OF THE FIGURES

Non-limiting example embodiments are described herein, with reference to the following accompanying Figures:

FIG. 1 shows smooth-surfaced walls 110/smooth-surfaced corner angle pieces 110, and ridged walls 106/ridged corner angle pieces 106 having ridges 107, which walls bypass one another at intersections 109 and 112. The ridges 107 in the ridged walls/corner angle pieces create an advection space 108 between these two structures (i.e. smooth-surfaced walls/corner angle pieces and the ridged walls/corner angle pieces). The side smooth walls and side ridged walls, taken together form the side boundary (ies) of a fabricated system;

FIG. 2 shows a smooth-surfaced molded outer container 210 and a ridged wall inner container 206. The ridges 207 create an advection space 208 between these two structures (i.e. smooth-surfaced outer container and the ridged inner container). The smooth-surfaced outer container and ridged inner container, taken together may form the side boundary(ies) (and/or bottom boundary) of a molded system;

DETAILED DESCRIPTION

Figure 1:
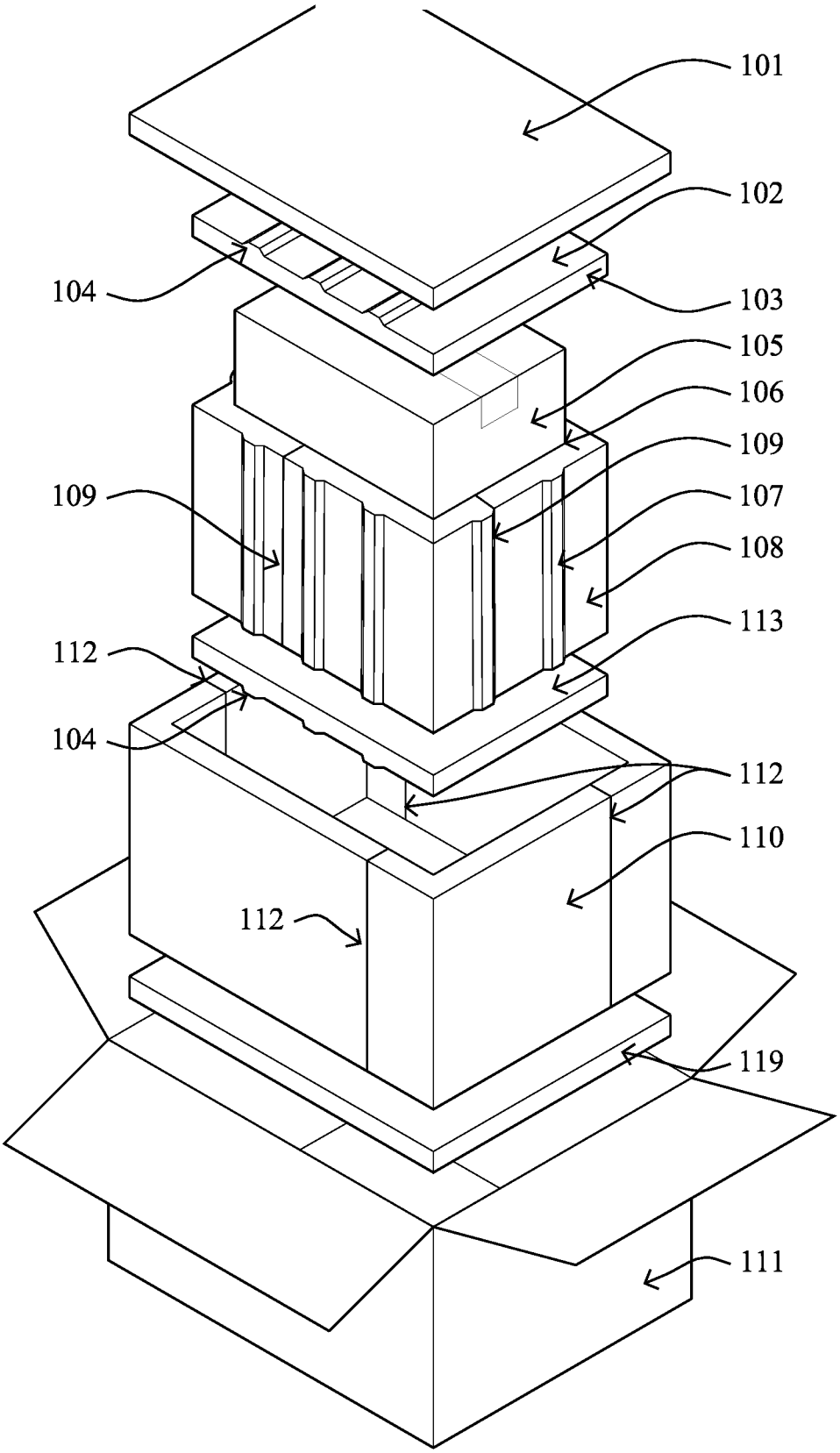
FIG. 1 depicts an exploded view of a fabricated insulated container in accordance with non-limiting example embodiments of the present invention. In particular.

Additional aspects, advantages and/or other features of example embodiments of the invention will become apparent in view of the following detailed description. It should be apparent to those skilled in the art that the described embodiments provided herein are merely exemplary and illustrative and not limiting. Numerous embodiments of modifications thereof are contemplated as falling within the scope of this disclosure and equivalents thereto.

In describing example embodiments, specific terminology is employed for the sake of clarity. However, the embodiments are not intended to be limited to this specific terminology. Unless otherwise noted, technical terms are used according to conventional usage.

As used herein, "a" or "an" may mean one or more. As used herein "another" may mean at least a second or more. As used herein, unless otherwise required by context, singular terms include pluralities and plural terms include the singular.

The presently disclosed invention contemplates an improved compound insulation system or construction for insulated shipping containers, which includes at least two bounding surfaces positioned such that at least one open space is formed therebetween, which allows the system to exhibit superior thermal resistance properties as compared to systems that do not provide such space.

In particular, provided herein are insulated shipping containers and shipping container systems that include smooth side walls and corresponding ridged side walls. The smooth side walls and corresponding ridged side walls face one another and have one or more ridges therebetween, such that taken together, the facing smooth side walls and ridged walls form at least one side space therebetween and form outer side boundaries of an insulated shipping container, in which a container or box may be contained. The insulated shipping containers may also include a top and/or bottom boundary that also include at least two layers, having ridges or other spacer therebetween to form at least one top and/or bottom space.

The present systems may further include an over-shipper box and/or one or more inner/interior boxes, which may be adapted to include e.g., a payload and/or heat transfer element therein for temperature control. Further provided are kits which may include one or more components used in the present containers and/or systems, and methods of assembling such containers and/or systems.

The presently disclosed invention contemplates that components or pieces thereof may be constructed using foamed polystyrene and/or foamed polyurethane and/or foamed polyethylene and/or foamed polyisocyurinate and/or vacuum insulated panels and/or blistered films and laminates and/or a variety of cellulous-based, starch-based or mycological-based insulating materials and the like, and combinations thereof.

The insulated shipping container may be a fabricated shipping container, in which smooth side walls include three or more (preferably four) smooth side walls or smooth corner pieces, and the ridged side walls comprise include three or more (preferably four) ridged side walls or ridged corner pieces. According to example embodiments, edges of the corner pieces (which include smooth corner pieces and ridged corner pieces) are offset from one another.

Smooth sidewalls and said smooth corner pieces meet together at intersections, and said ridges bypass said intersections.

Thus, the present invention provides an insulated container system, which includes three or more (preferably four) smooth side walls or smooth corner pieces, and three or more (preferably four) corresponding ridged side walls or ridged corner pieces. The smooth walls/corner pieces, face corresponding ridged walls/ridged corner pieces, with one or more ridges therebetween, such that taken together, the facing walls/corner pieces and ridged walls/corner pieces form at least one side space therebetween and form outer side boundaries of an insulated container.

Further embodiments may include a bottom smooth surface and a bottom ridged surface and the bottom ridged surface faces the bottom smooth surface with one or more ridges therebetween, such that taken together the bottom ridged surface and bottom smooth surface form at least one bottom space therebetween and form a bottom boundary of the insulated container.

According to further example embodiments, the present container system may also include a bottom surface or boundary and/or a top surface or boundary. Thus, according to example embodiments, the container system may include a bottom smooth surface and a bottom ridged surface, in which the bottom ridged surface faces (and may contact) the bottom smooth surface, with one or more ridges therebetween, such that taken together the bottom ridged surface and bottom smooth surface form at least one bottom space therebetween and form a bottom boundary of the insulated container. The at least one of said bottom space, may be filled with a fluid such as a liquid and/or gas.

While it is contemplated that the container system boundary may include three or more sides and optionally a top and/or bottom boundary, according to non-limiting example embodiments, the container system may include four sides, a bottom boundary and a top boundary.

According to example embodiments, the insulated shipping container is a molded shipping container, in which smooth side walls include a smooth molded container, and ridged side walls include a molded container having ridges on the outside of the ridged container when the molded container having ridges is adapted to be fit within the smooth molded container; or said ridged side walls include a molded container having ridges on the inside of the ridged container when the smooth molded container is adapted to be fit within the molded container having ridges.

The insulated shipping container may include both a molded container and a corresponding fabricated container, which taken together form the outer side boundaries of an insulated shipping container.

According to further example embodiments, the container system may include a top smooth surface and a top ridged surface, in which the top ridged surface faces (and may contact) the top smooth surface, with one or more ridges therebetween, such that taken together the top ridged surface and top smooth surface form at least one top space therebetween and form a top boundary of the insulated container. According to example embodiments, the top boundary forms a cooperative fit with the ridged and/or smooth side walls or corner pieces. According to example embodiments, the top space, is filled with a fluid selected from the group consisting of a liquid and gas.

The presently disclosed invention contemplates that ridges, spacers, and/or supports are used between fabricated and/or molded walls to define a contiguous space, where "ridge", "spacer" or "support" refers to any feature on the face of at least one bounding surface. That is the ridge or spacer is between a smooth wall or smooth corner piece, and a corresponding, facing ridged wall or ridged corner piece, which together form a side, bottom or top boundary. The ridge (or spacer or support) is positioned/formed between the bounding surfaces in the insulation construction. The contiguous space may be throughout the device, e.g. in each of the panels or throughout the molded walls, or it may be contiguous through multiple panels or walls, such as throughout the side walls and top or bottom walls.

A ridge, spacer or support may be ridged or flexible and it may be integral with, attached to or independent of the bounding surfaces, as long as the ridge or spacer or support structures perform the function of supporting and/or holding two bounding surfaces a predetermined space apart. Although the figures depict ridges as being part of the walls, the present invention should not be deemed as being limited to such embodiments.

A ridge, spacer or support may take the form of a ridge or boss or flute or bumper or clip or other shaped structure, or a spacer or support may take the form of a native material surface imperfection or artifact, such as the rough or crinkled or pilled textured surfaces that are commonly found on foamed plastic materials, where the space produced by the imperfection may visually appear to be airtight but through which a space that allows a fluid such as air, to migrate. Ridges may be in the form of corrugations of a corrugated material. Ridges may be shaped so as to form groves or channels. Also, the ridges may be shaped as long, thin bumps, or they may be square, round or irregular shapes. The shape and size are not intended to be limiting, so long as sufficient space is formed between bounding surfaces such that the bounded surfaces are in communication with at least 50% of bounded space formed by the ridges. That is, according to non-limiting example embodiments, at least 50% of the bounding surfaces are exposed to space internal to the walls. In other words, the ridges don't cover at least 50% of the surfaces that face each other.

"Space" or "bounded space" refers to any gap between two bounding surfaces, whether on the sides of the container, bottom and/or top. According to example embodiments, at least 50% of each bounding surface (i.e., the inside facing walls of a boundary) is in communication with (preferably contiguous communication with) bounded space (between the bounding surfaces). According to further example embodiments, at least 60%, 70%, 80%, 90% or more of each bounding surface is in communication with bounded space. "Space" or "bounded space" may be in communication with bounding surfaces by having air in communication with the surfaces, and/or by having a fluid such as a gas, liquid, or gel or bladder or other container containing a gas, liquid or gel in communication with bounding surfaces. The space may be between bounding surfaces on each side (optionally including top and bottom) of a completely fabricated container (inner and outer walls); or it may be between a molded outer container and a molded inner container; or it may be between a fabricated outer container and a molded inner container; or space may be between a molded outer container and a fabricated inner container.

The presently disclosed invention contemplates that space within boundary walls, lid (top) or base (bottom) panels does not necessarily have to be contiguous and communicative between the walls, lid and/or base panels, even though the contiguity of the space within and between the walls lids or base panels may be preferred in certain embodiments.

The presently disclosed invention contemplates that the space (such as contiguous space) within each wall, lid or base panels may be bounded or sealed on any or all edges but does not have to be.

The presently disclosed invention contemplates that the space (such as contiguous space) within each wall, lid or base panel can be filled with a fluid that can be a liquid, such as water, or a gas, such as air. Therefore, according to non-limiting example embodiments at least one of the side, bottom and/or top spaces created between boundary layers may be filled (completely or partially) with at least one fluid, such as liquid or a gas (such as air).

In yet further embodiments of the herein disclosed invention, a water-filled bladder or jacket is bounded by opposing layers of insulation and acts as the space in any of the embodiments herein. The bladder(s) may be filled with a fluid e.g. gas, liquid or gel.

FIG. 1 depicts an exploded view of a fabricated insulated container in accordance with non-limiting example embodiments of the present invention. FIG. 1 shows smooth-surfaced walls 110/smooth-surfaced corner angle pieces 110, and ridged walls 106/ridged corner angle pieces 106 having ridges 107 bypassing one another at intersections 109 and 112. The ridges 107 in the ridged walls/corner angle pieces create an advection space 108 between these two structures (i.e. smooth-surfaced walls/corner angle pieces and the ridged walls/corner angle pieces). In the exploded view of FIG. 1, it can be seen that when the system is assembled, the ridged pieces 107 may bypass at the intersection 112, and create an advection space 108 between these two structures (i.e. smooth-surfaced walls/corner angle pieces 110 and the ridged walls/corner angle pieces 106).

According to example embodiments, and as shown e.g., in FIG. 1, side smooth surfaces and side smooth corner pieces meet together at intersections, and ridged sides and corners bypass the intersections of the smooth pieces. That is, a side of the container may include more than one smooth piece or corner piece that meets together at one or more intersections. Similarly, ridged sides and corners meet together at intersections and the smooth sides and corner pieces bypass the intersections of the ridged pieces. A space is formed between the smooth piece(s) and a ridged piece by one or more ridges or spacers, that may be located adjacent to intersection(s) or offset from (not overlapping with) intersection(s).

FIG. 1 also shows a ridged top pad 103 having ridges 104, such that when a smooth surfaced top pad 101 is provided with a top ridged pad 103, ridges 104 therebetween form advection space 102 between ridges, between the top smooth pad and the top ridged pad (which taken together form a top boundary). According to non-limiting example embodiments the ridged top pad may be smaller (length times width) than the smooth top pad. In example embodiments in which the outermost top pad is the ridged pad and the inner pad is the smooth pad (not shown), the outer ridged pad may be larger (length×width) than the inner top smooth pad.

According to non-limiting example embodiments, the bottom of the container may also include a smooth bottom pad 119 and a ridged bottom pad 113 (which together would form a bottom boundary). The smooth bottom pad and ridged bottom pad preferably have bottom space therebetween due to ridges therebetween.

Figure 3:
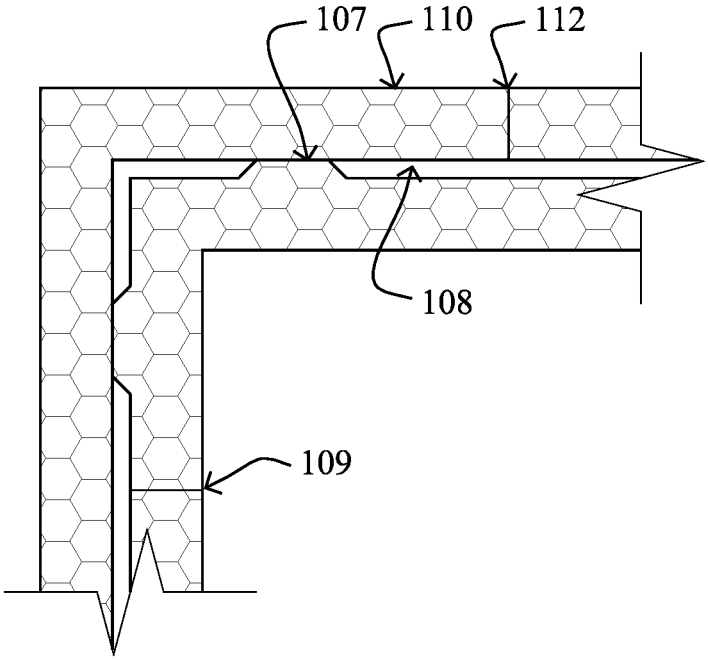
FIG. 3 depicts advection space 108 created in the embodiment of FIG. 1.

The insulated container of FIGS. 1 and 3 show smooth-surfaced walls 110/corner angle pieces 110, and ridged walls 106/corner angle pieces 106 having ridges 107 bypassing at the intersection 109 between smooth surfaces of walls, and create an advection space 108 between these two structures (the smooth surfaced walls and ridged walls).

According to non-limiting example embodiments (not shown), the smooth surfaced walls/corner angle pieces may be the inside walls of one or more sets of bounding walls, and the ridged walls may be the outer wall of one or more sets of bounding walls, so long as the ridges are between the walls so as to form an advection space therebetween.

According to the example embodiment of FIG. 1, the container is assembled within an over-shipper box 111, in which the system may be contained. This does not imply the order in which the assembly takes place. That is, the container may be formed piece by piece within the over-shipper box, or it may be partially or fully assembled outside the over-shipper box and thereafter placed into the over-shipper box.

FIG. 1 also depicts an inside or interior box 105, that may be contained within the present system for holding e.g. payload and/or any heat transfer element(s).

In the embodiment of FIG. 1 smooth and ridged side walls may form a cooperating fit, such as a keyed cooperating fit with a smooth top pad and a ridged top pad.

Figure 2:
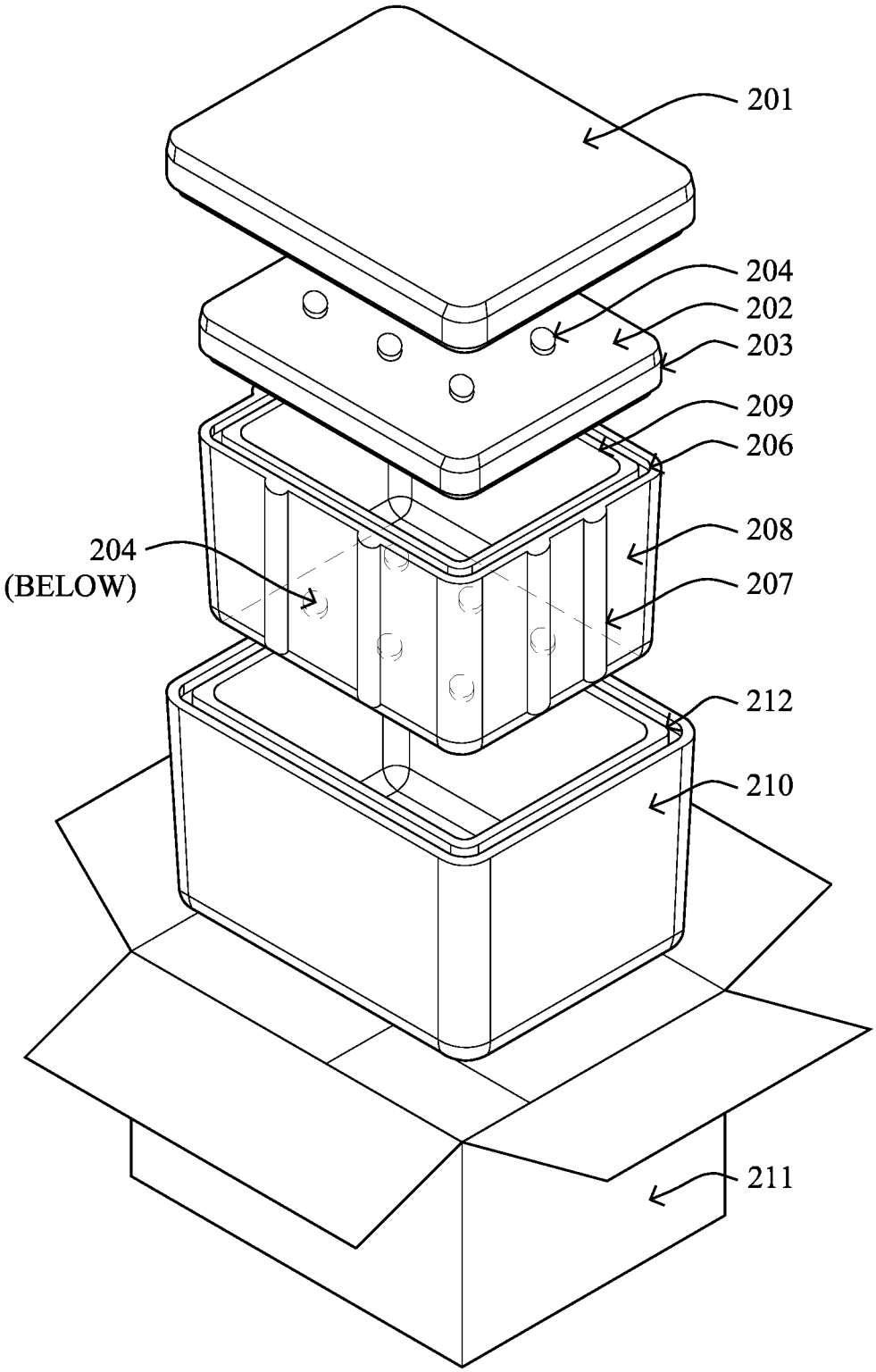
FIG. 2 depicts an exploded view of a molded insulated container in accordance with non-limiting example embodiments of the present invention. In particular.

FIG. 2 depicts an exploded view of a molded insulated container in accordance with non-limiting example embodiments of the present invention. In particular, FIG. 2 shows a smooth-surfaced molded outer container 210 and a ridged wall molded inner container 206. The ridges 207 create an advection space 208 between these two structures (i.e. smooth-surfaced molded outer container 210 and the ridged molded inner container 206). The smooth-surfaced outer container and ridged inner container, taken together may form the side boundary (ies) (and/or bottom boundary) of a molded system. The advection space 208 between 210 and 206 is further illustrated in FIG. 4.

FIG. 2 also shows a top ridged lid 203 having ridges 204, such that when a smooth surfaced top lid 201 is provided with a top ridged lid 203, ridges 204 therebetween form advection space between ridges, between the top smooth lid and the top ridged lid (which taken together form a top boundary). According to non-limiting example embodiments the ridged top lid may be smaller (length times width) than the smooth top lid. In example embodiments in which the outermost top lid is the ridged lid and the inner lid is the smooth lid (not shown), the outer ridged lid may be larger (length×width) than the inner top smooth lid.

According to non-limiting example embodiments (not shown), the smooth surfaced molded container may be the inner container, and the ridged wall molded container may be the outer container, which together from bounding walls, so long as the ridges are between the walls so as to form an advection space therebetween.

According to the example embodiment of FIG. 2, the container is assembled within an over-shipper box 211, in which the system may be contained. That is, the container may be formed piece by piece within the over-shipper box, or it may be partially or fully assembled outside the over-shipper box and thereafter placed into the over-shipper box.

FIG. 2 does not show an inside or interior box, but such a box may be contained within the present system for holding e.g. payload and/or any heat transfer element(s).

Top edges 209 and 212 of the ridged molded container 206 and smooth molded container 210, respectively, may form a cooperating fit, such as a keyed cooperating fit with one or more lid pieces such as a smooth lid 201 and a ridged lid 203. For example, top edges 209 and 212 may be keyed and have a tongue and groove arrangement to form a cooperative fit with lid pieces 201 and 203.

In an example embodiment of the herein disclosed invention, a primary insulated shipping container is fabricated using six primary smooth-surface pads, where five of these smooth-surface pads form a substantially hollow cuboid-shaped insulated base container and the sixth pad forms a lid. Nested within the primary insulated shipping container may be a secondary insulated shipping container including six pads, where five of these pads form a substantially hollow cuboid-shaped insulated base container and the sixth pad forms a lid. On one surface of each pad set spacers are arranged and configured to space one pad set away from the other bounding a substantially contiguous space therebetween. Where the primary and secondary pad sets intersect the joints are staggered or over-lapped or stepped such that the joints are lengthened as much as possible to prevent the transmission of heat through the joint. Additionally, to discourage the transmission of heat through open joints, and to hold the wall construction in its intended configuration an interior box may be inserted into the interior cuboid cavity. According to example embodiments, corners of fabricated embodiments may be woven corners In other non-limiting example embodiments of the herein disclosed invention, a primary insulated shipping container is fabricated using four foam angles and two foam pads, where the four foam angles form the vertical corners and some portion of two adjacent walls of a substantially hollow cuboid-shaped base container and the fifth and sixth pads form the base floor and lid thereof. Nested within the primary insulated shipping container is a secondary insulated shipping container, which is fabricated using four foam angles and two foam pads, where the four foam angles form the vertical corners and some portion of two adjacent walls of a substantially hollow cuboid-shaped base container and the fifth and sixth pads form the base floor and lid thereof. On one surface of each pad set spacers are arranged and configured to space one pad set away from the other bounding a substantially contiguous space therebetween. Where the primary and secondary angle and pad sets intersect the joints are staggered or over-lapped or stepped such that the joints are lengthened as much as possible to prevent the transmission of heat through the joint. Additionally, to discourage the transmission of heat through open joints, and to hold the wall construction in its intended configuration an interior box may be inserted into the interior cuboid cavity.

In further embodiments of the herein disclosed invention, a primary insulated shipping container is molded into a monolithic substantially hollow cuboid-shaped base with a monolithic lid. Nested within the primary insulated shipping container is a secondary insulated shipping container that is molded into a monolithic substantially hollow cuboid-shaped base with a monolithic lid. On one opposing surface of one or both primary or secondary insulated shipping containers spacers are arranged and configured to space one insulated shipping container away from the other thereby bounding a substantially contiguous space therebetween. As the primary and secondary insulated shipping containers are monolithic by design, the bounded space may be substantially contiguous throughout all five walls and the lid thereby creating a substantially contiguous space within the resulting wall structure such that significantly all of the fluid within the bounded space is in continuous communication with the bounded surface area of the primary and secondary insulated shipping containers.

According to example embodiments, the present insulated container systems may include an over-shipper box in which the insulated container may be placed or assembled. The over-shipper box may be used e.g., to help keep panels of a fabricated embodiment together, or for shipping purposes. The over-shipper box may be made of any suitable material, including, but not limited cardboard, which may be used for example for storage and/or shipping. The over-shipper box may be any suitable shape, including but not limited to a cuboid shape (which includes cubes, square prisms and other cuboids), but does not have to be such a shape, provided that it is shaped to be capable of holding the present insulated container system therein. Other non-limiting example embodiments may include for example a cylindrical shape or other shape that may be required depending for example on the shape of the shipping container, inner box and/or payload shape or shape requirements.

According to non-limiting example embodiments, panels (in fabricated embodiments) or lids (in either fabricated or molded embodiments) may be shaped e.g. with groves to fit together to help hold the pieces together. According to further non-limiting example embodiments, rivets or other fastening devices may be used to attach panels or other pieces of the present containers together.

According to example embodiments, the interior dimensions of side boundaries of the present shipping containers (formed by side, bottom and/or top boundaries, or formed by molded containers) are suitable such that an inner/interior box may be placed therein.

Accordingly, example insulated container systems may also include at least one inner box. The inner box may be made of any suitable material, including, but not limited cardboard or corrugated liner board, which may be used for example for containing at least one payload item and/or at least one heat transfer element. The inner box may be a cuboid shape (which includes cubes, square prisms and other cuboids), but does not have to be such a shape, provided that it is shaped to be capable of holding the present insulated container system therein. Other suitable shapes may include cylindrical or spherical or any other required or desired shape.

Figure 4:
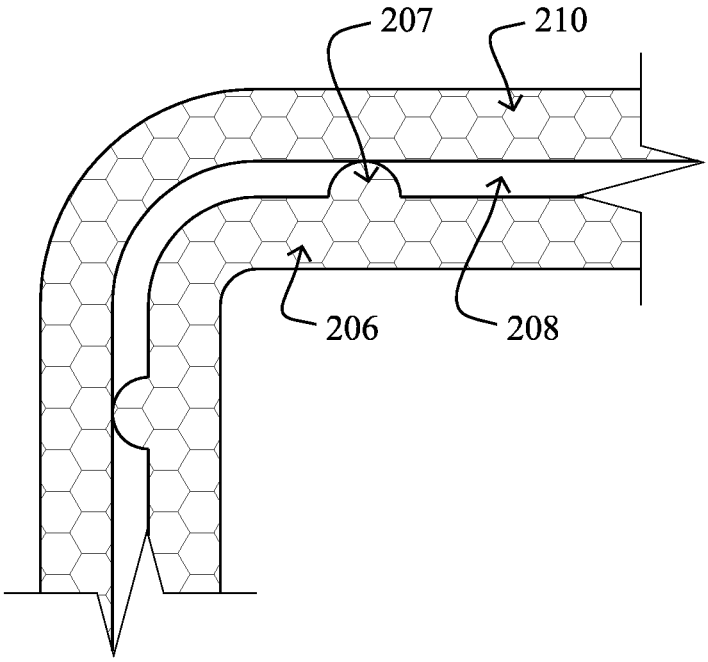
FIG. 4 depicts advection space 208 created in the embodiment of FIG. 2.

The present container systems may include elements (such as molded portions) that do not have squared off edges or corners, but rather may included rounded corners, as shown e.g., in FIGS. 2 and 4.

Further provided herein are container systems that may include an outer set of walls that is fabricated (either smooth or ridged) and an inner container that is molded (either smooth or ridged) so long as either one of the walls is ridged to provide ridges between the walls to form advection space, or so long as ridges are otherwise provided between the walls to form such space.

Further provided herein are container systems that may include an outer set of walls that is molded (either smooth or ridged) and an inner container that is fabricated (either smooth or ridged) so long as either one of the walls is ridged to provide ridges between the walls to form advection space, or so long as ridges are otherwise provided between the walls to form such space.

Further provided herein are kits that may include any of the present insulated shipping containers or container systems and/or components thereof.

By way of non-limiting example, included herein are kits that include one or more fabricated smooth side walls or smooth corner pieces; and one or more ridged side walls or ridged corner pieces; the one or more smooth side walls or smooth corner pieces and one or more ridged side walls or ridged corner pieces may be configured in size and shape such that they may be assembled together along with one or more ridges therebetween to form an outer boundary of an insulated shipping container.

Alternatively, provided herein are kits that may include one or more smooth molded pieces that form walls; and/or one or more ridged molded pieces; the one or more smooth molded pieces and one or more ridged molded pieces may be configured in size and shape such that they may be assembled together along with one or more ridges therebetween to form an outer boundary of an insulated shipping container.

Example kits may also include instructions for assembly or use of the present improved compound insulation construction and/or optional additional components of example improved compound insulation construction or things to be inserted therein. Thus, according to further example embodiments, kits herein may include instructions for assembling the insulated shipping container.

According to further examples, the present kits may include at least one additional component such as at least one bottom smooth surface, bottom ridged surface, top/lid smooth surface, and/or top/lid ridged surface, or ridges or spacers (if they are separate from the molded or fabricated wall surface(s)). Example kits may also include one or more base or lid components.

Example kits may also include at least one tool or device or apparatus that may be used in the assembly, or use of the present insulated shipping container or systems, or for securing the insulated shipping container together.

Further embodiments may optionally include an over-shipper box and/or an inner box.

Also included herein are methods of making, assembling and/or using the present insulated shipping containers having compound insulation. Example methods may include methods of assembling a fabricated insulated shipping container, which include forming an outer boundary of an insulated container, which outer boundary may include smooth side walls and corresponding ridged side walls, wherein the smooth side walls and corresponding ridged side walls face one another and have one or more ridges therebetween, such that taken together, the facing smooth side walls and ridged walls form at least one side space therebetween and form outer side boundaries of an insulated shipping container.

According to example embodiments, the forming may include placing a first molded container within a second molded container, wherein said first and second molded containers are separated by at least one ridge or spacer to form air space between the first and second molded containers.

Non-limiting example embodiments include forming an outer boundary of an insulated container, which includes forming three or more (preferably four) smooth side walls or smooth corner pieces joined together at intersections, and three or more (preferably four) corresponding ridged side walls or ridged corner pieces. In example methods, the smooth side walls/corner pieces face corresponding ridged walls/corner pieces, with one or more ridges therebetween, such that taken together, the facing side walls/corner pieces and ridged walls/corner pieces form at least one side space therebetween.

Example methods may also include forming a bottom boundary of the fabricated insulated container, in which the bottom boundary includes at least one bottom smooth surface and at least one bottom ridged surface, and in which the bottom ridged surface faces the bottom smooth surface with one or more ridges therebetween, such that taken together the bottom ridged surface and bottom smooth surface form at least one bottom space therebetween.

Further example methods may include forming a top boundary of the fabricated insulated container, in which the top boundary includes at least one top smooth surface and at least one top ridged surface, and in which the top ridged surface faces the top smooth surface with one or more ridges therebetween, such that taken together the top ridged surface and top smooth surface form at least one top space therebetween.

The present containers may be fully or partially assembled before placing them within the over-shipper box, or they may be assembled with the over-shipper container. Similarly, any inner box may be placed within the container before the container is placed in the over-shipper box. Alternatively, the container may be placed within an over-shipper box before any inner box is placed therein.

The following example is provided to further illustrate various non-limiting embodiments and techniques. It should be understood, however, that this example is meant to be illustrative and do not limit the scope of the claims. As would be apparent to skilled artisans, many variations and modifications are intended to be encompassed within the spirit and scope of the invention.

EXAMPLE

Example 1

The inventors tested identically sized foam insulated shipping container systems containing the same arrangement of product and refrigerant inside. All test samples were constructed with 2 lbs. per cubic foot density expanded polystyrene (EPS) foam insulation.

Test Sample 1 used a molded insulated shipping container with a monolithic base and a lid with solid 1½ inch thick walls.

Test Sample 2 used a standard six-pad fabricated insulated shipping container with solid 1½ inch thick walls. Additionally, to discourage the transmission of heat through open joints, and to hold the wall construction in its intended configuration an interior box was inserted into the insulated shipping container's cuboid interior cavity.

Test Sample 3 used an improved eight-angle and four-pad fabricated composite wall insulated shipping container where two layers of foam were offset with ⅛ inch spacers bounding a contiguous space filled with air at ambient pressure within the insulation walls, base and lid, for a total composite wall thickness of 1½ inches. Layer 1 included four ¾ inch thick fabricated foam angles to form the vertical corner edges and some part of each adjacent wall and two ¾ inch thick pads to form the base and lid in Layer 1. Layer 2 also included four ¾ inch thick fabricated foam angles to form the vertical corner edges and some part of each adjacent wall and two ¾ inch thick pads to form the base and lid in Layer 2, except the surface of these components that faced Layer 1 were fabricated with 1 inch wide ridges spaced 3 inch apart forming the spacers that bound the contiguous ⅛ inch space therebetween. Additionally, to discourage the transmission of heat through open joints, and to hold the wall construction in its intended configuration an interior box was inserted into the interior cuboid cavity.

A total of four (4) frozen 86-ounce aqueous-based refrigerant bricks were used in each test sample as the heat transfer elements. All refrigerants were preconditioned to −3° C., +/−2° C.

Each test used simulated product payload included ninety-three (93) 20 ml vials, each filled with 15 ml water placed inside individual 18 pt. chipboard folding cartons.

Testing was conducted in an environmental chamber at ambient humidity and atmospheric pressure using the International Safe Transport Association (ISTA) 7d summer ambient profile.

Calibrated thermistors were dipped into the simulated product payload units located in the top and bottom corners and top and bottom center positions of a prescribed payload box. Additionally, calibrated thermistors were placed between the top layer of heat transfer elements and in two locations within the environmental chamber: the top front center and the bottom rear center.

The results of this testing are set forth in Table 1 below:

TABLE 1

| | Report | Design | MIN Low | MIN High | HOURS to 8° C. |
|---|---|---|---|---|---|
| Test Sample 1 | CT-120126-A | Molded EPS | 2.03° C. | 4.40° C. | 56.50 |
| Test Sample 2 | CT-131022-A | Fabricated 6-Part EPS | 1.10° C. | 3.11° C. | 50.83 |
| Test Sample 3 | CT-131206-A | Fabricated 12-Part EPS | 2.07° C. | 3.76° C. | 57.50 |

These summarized test results show that Test Sample 1 (molded EPS insulated shipping container) performed better than Test Sample 2 (standard six-pad fabricated EPS insulated shipping container), which supports current industry consensus that molded insulated shipping containers resist heat transfer better than fabricated insulated shipping containers.

These summarized test results also show that Test Sample 3 (i.e., improved eight-angle and four-pad fabricated EPS insulated shipping container, in accordance with non-limiting example embodiments of the present invention) performed as well as, or better than Test Sample 1 (molded EPS insulated shipping container), as evidenced by the higher MIN low (2.07° C. versus 2.03° C.), the system duration to 8° C. (57.50 hours versus 56.50 hours) and the Δt between the MIN low and MIN high (2.37° C. versus 1.30° C.).

In the foregoing specification, the invention has been described with reference to specific embodiments thereof. It will, however, be evident that various modifications and changes may be made thereto without departing from the broader spirit and scope of the invention. Accordingly, it is intended that such changes and modifications fall within the scope of the present invention as defined by the claims appended hereto. The specification and drawings are, accordingly, to be regarded in an illustrative rather than restrictive sense. Therefore, the present invention is not limited to the present examples. In view of the teachings provided herein, one having ordinary skill in the art would recognize other applications for which the present invention could be used. One having ordinary skill in the art would be able to use the systems, devices and methods of the present invention in other applications. Accordingly, these alternative uses are intended to be part of the present invention.

We claim:

1. An insulated shipping container system comprising insulated smooth side walls comprising insulating material and corresponding insulated ridged side walls comprising insulating material, wherein said insulated smooth side walls and corresponding insulated ridged side walls face one another and have one or more ridges therebetween, said ridges being present vertically from a lower end of the insulated ridged side walls to an upper end of the ridged side walls, such that taken together, the facing insulated smooth side walls and insulated ridged walls form at least one vertical side advection space therebetween formed by said ridges, said vertical side advection space being configured in size, spacing, orientation, and configuration to permit advection, and wherein said insulated smooth side walls and corresponding insulated ridged side walls form outer side boundaries of an insulated shipping container, wherein said at least one side vertical advection space is bounded on both sides by insulated material.

2. The insulated shipping container system of claim 1, wherein said insulated shipping container comprises a fabricated shipping container, wherein the insulated smooth side walls comprise three or more insulated smooth side walls or insulated smooth corner pieces, and wherein said insulated ridged side walls comprise three or more insulated ridged side walls or insulated ridged corner pieces; wherein edges of the corner pieces comprising the insulated smooth corner pieces and insulated ridged corner pieces, wherein edges of the corners are offset from one another.

3. The insulated shipping container system of claim 2, further comprising a bottom insulated smooth surface and a bottom insulated ridged surface, wherein the bottom insulated ridged surface faces the bottom insulated smooth surface with one or more ridges therebetween, such that taken together the bottom insulated ridged surface and bottom insulated smooth surface form at least one bottom advection space therebetween and form a bottom boundary of the insulated container.

4. The insulated shipping container system of claim 2, wherein said insulated smooth side walls and said insulated smooth corner pieces meet together at intersections, and said ridges bypass said intersections.

5. The insulated shipping container system of claim 3, wherein at least one of said bottom advection space, is filled with a fluid selected from the group consisting of a liquid and gas.

6. The insulated shipping container system of claim 1, wherein said insulated shipping container comprises a molded shipping container, wherein the insulated smooth side walls comprise a smooth molded container, and wherein said insulated ridged side walls comprise a molded container having ridges on the outside of the ridged container when the molded container having ridges is adapted to be fit within the smooth molded container; or wherein said insulated ridged side walls comprise a molded container having ridges on the inside of the ridged container when the smooth molded container is adapted to be fit within the molded container having ridges.

7. The insulated shipping container system of claim 1, wherein said insulated shipping container comprises a molded container and a corresponding fabricated container, which taken together form the outer side boundaries of an insulated shipping container.

8. The insulated shipping container system of claim 1, further comprising a top smooth surface and a top insulated ridged surface, wherein the top insulated ridged surface faces the top smooth surface with one or more ridges therebetween, such that taken together the top insulated ridged surface and top smooth surface form at least one top advection space therebetween and form a top boundary of the insulated container.

9. The insulated shipping container system of claim 8, wherein the top boundary forms a cooperative fit with the insulated ridged side walls and/or smooth side walls.

10. The insulated shipping container system of claim 8, wherein at least one of said top advection space is filled with a fluid selected from the group consisting of a liquid and gas.

11. The insulated shipping container system of claim 1, wherein at least one of said side advection space is filled with a fluid selected from the group consisting of a liquid and gas.

12. The insulated shipping container system of claim 1, further comprising an over-shipper box in which over-shipper box, the insulated container may be placed or assembled.

13. The insulated shipping container system of claim 1, wherein interior dimensions of the side boundaries of the insulated container are configured such that an interior box may be placed therein.

14. A method of assembling an insulated shipping container comprising forming an outer boundary of an insulated container, comprising insulated smooth side walls comprising insulating material and corresponding insulated ridged side walls comprising insulating material, wherein the insulated smooth side walls and corresponding insulated ridged side walls face one another and have one or more ridges therebetween, said ridges being present vertically from a lower end of the insulated ridged side walls to an upper end of the ridged side walls, such that taken together, the facing insulated smooth side walls and insulated ridged walls form at least one vertical side advection space therebetween formed by said ridges, said vertical side advection space being configured in size, spacing, orientation, and configuration to permit advection, and wherein said insulated smooth side walls and corresponding insulated ridged side walls form outer side boundaries of an insulated shipping container, wherein said at least one vertical side advection space is bounded on both sides by insulated material.

15. The method of claim 14, wherein said forming comprises placing a first molded container within a second molded container, wherein said first and second molded containers are separated by at least one ridge or spacer to form air space between the first and second molded containers.

16. The method of claim 14, wherein forming an outer boundary of an insulated container, comprises forming three or more insulated smooth side walls or insulated smooth corner pieces joined together at intersections, and three or more corresponding insulated ridged side walls or insulated ridged corner pieces, wherein the insulated smooth side walls/corner pieces face corresponding insulated ridged walls/corner pieces, with one or more ridges therebetween, such that taken together, the facing side walls/corner pieces and insulated ridged walls/corner pieces form at least one side advection space therebetween, wherein edges of the corners are offset from one another.

17. The method of claim 16, further comprising forming a bottom boundary of the insulated container, said bottom boundary comprising at least one bottom smooth surface and at least one bottom insulated ridged surface, wherein the bottom insulated ridged surface faces the bottom smooth surface with one or more ridges therebetween, such that taken together the bottom insulated ridged surface and bottom smooth surface form at least one bottom advection space therebetween.

18. The method of claim 14, further comprising forming a top boundary of the insulated container, said top boundary comprising at least one top smooth surface and at least one top insulated ridged surface, wherein the top insulated ridged surface faces the top smooth surface with one or more ridges therebetween, such that taken together the top insulated ridged surface and top smooth surface form at least one top advection space therebetween.

19. A shipping container kit comprising one or more insulated smooth side walls comprising insulating material or insulated smooth corner pieces comprising insulating material; and one or more insulated ridged side walls comprising insulating material or insulated ridged corner pieces comprising insulating material;

wherein the one or more insulated smooth side walls or insulated smooth corner pieces and one or more insulated ridged side walls or insulated ridged corner pieces are configured such that they may be assembled together along with one or more ridges therebetween to form an outer boundary of an insulated shipping container, said ridges being present vertically from a lower end of the insulated ridged side walls to an upper end of the ridged side walls, such that taken together, the insulated side walls/corner pieces and insulated ridged walls/corner pieces form at least one vertical side advection space therebetween formed by said ridges, said vertical side advection space being configured in size, spacing, orientation, and configuration to permit advection, and said vertical side advection space being bounded on both sides by insulated material.

20. The shipping container kit of claim 19, further comprising at least one additional component selected from the group consisting of instructions for assembling the insulated shipping container, a bottom smooth surface, bottom insulated ridged surface, top insulated smooth surface, top insulated ridged surface, at least one tool or device for assembling the insulated shipping container, an over-shipper box, and an inner box.

* * * * *